US008358260B2

(12) United States Patent
Takagi et al.

(10) Patent No.: US 8,358,260 B2
(45) Date of Patent: Jan. 22, 2013

(54) METHOD AND APPARATUS FOR ADAPTIVE BLACK FRAME INSERTION

(75) Inventors: Akihiro Takagi, San Mateo, CA (US); Cheng-Shih Chin, Campbell, CA (US); Yanli Zhang, San Jose, CA (US); Maximino Vasquez, Fremont, CA (US)

(73) Assignee: Intel Corporation, Santa Clara, CA (US)

( * ) Notice: Subject to any disclaimer, the term of this patent is extended or adjusted under 35 U.S.C. 154(b) by 870 days.

(21) Appl. No.: 12/384,500

(22) Filed: Apr. 6, 2009

(65) Prior Publication Data

US 2010/0253611 A1 Oct. 7, 2010

(51) Int. Cl.
*G09G 3/36* (2006.01)

(52) U.S. Cl. ..... 345/98; 345/88; 345/89; 345/92; 345/94; 345/102

(58) Field of Classification Search ..... 345/1.1, 345/88–108, 208–212, 419, 520, 521, 690, 345/698; 349/37–48; 348/14.08
See application file for complete search history.

(56) References Cited

U.S. PATENT DOCUMENTS 5,914,700 A * 6/1999 Tonosaki ..... 345/102
7,483,018 B2 * 1/2009 Oliver ..... 345/179
2002/0097208 A1 * 7/2002 Hashimoto ..... 345/87
2003/0112257 A1 * 6/2003 Tamura ..... 345/690
2005/0001857 A1 * 1/2005 Nakakita et al. ..... 345/690
2005/0073470 A1 * 4/2005 Nose et al. ..... 345/1.1
2006/0012676 A1 * 1/2006 Tomita ..... 348/51
2006/0066597 A1 * 3/2006 Sampsell ..... 345/204
2006/0187142 A1 * 8/2006 Lesniak ..... 345/1.1
2006/0279523 A1 * 12/2006 Nitta et al. ..... 345/102
2007/0070009 A1 * 3/2007 Mori et al. ..... 345/89
2007/0229447 A1 * 10/2007 Takahara et al. ..... 345/102
2008/0284768 A1 * 11/2008 Yoshida et al. ..... 345/208
2009/0213042 A1 * 8/2009 Hagino et al. ..... 345/55
2009/0225069 A1 * 9/2009 Sampsell ..... 345/212
2009/0322660 A1 * 12/2009 Chung et al. ..... 345/87
2010/0026678 A1 * 2/2010 Sakashita ..... 345/213

* cited by examiner

*Primary Examiner* — Prabodh M Dharia
(74) *Attorney, Agent, or Firm* — Jordan IP Law, LLC

(57) ABSTRACT

A display device may include a flat panel display, and a controller coupled to the flat panel display. The controller may be configured to determine an operating mode for the flat panel display among a plurality of operating modes including at least a first operating mode and a second operating mode. In the first operating mode, the controller may set the flat panel display to utilize a first frame rate and a first inversion mode to save power. In the second operating mode, the controller may set the flat panel display to utilize a second frame rate, a second inversion mode, and a black frame insertion to improve image quality. The second frame rate may be faster than the first frame rate. The second inversion mode and black frame insertion may be mutually configured to maintain a DC balanced operation of the flat panel display.

28 Claims, 6 Drawing Sheets

METHOD AND APPARATUS FOR ADAPTIVE BLACK FRAME INSERTION

The invention relates to flat panel displays. More particularly, some embodiments of the invention relate to black frame insertion for a processor-based system having a flat panel display.

BACKGROUND AND RELATED ART

Black frame insertion (BFI) is a motion picture technology which may be applicable to liquid crystal display (LCD) flat panel televisions. Black frame data may be inserted after every picture data frame to mitigate the LCD's holding effect. This technology has been used for television applications but has problems when applied to some processor-based applications.

BRIEF DESCRIPTION OF THE DRAWINGS

Various features of the invention will be apparent from the following description of preferred embodiments as illustrated in the accompanying drawings, in which like reference numerals generally refer to the same parts throughout the drawings. The drawings are not necessarily to scale, the emphasis instead being placed upon illustrating the principles of the invention.

DESCRIPTION

In the following description, for purposes of explanation and not limitation, specific details are set forth such as particular structures, architectures, interfaces, techniques, etc. in order to provide a thorough understanding of the various aspects of the invention. However, it will be apparent to those skilled in the art having the benefit of the present disclosure that the various aspects of the invention may be practiced in other examples that depart from these specific details. In certain instances, descriptions of well known devices, circuits, and methods are omitted so as not to obscure the description of the present invention with unnecessary detail.

Figure 1:
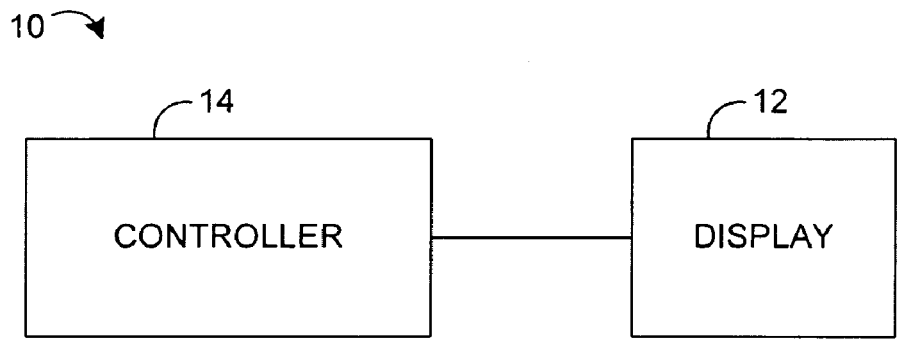
FIG. 1 is a block diagram of a display device in accordance with some embodiments of the invention.

With reference to FIG. 1, in accordance with some embodiments of the invention a display apparatus 10 may include a flat panel display 12 and a controller 14 coupled to the flat panel display 12. For example, the controller 14 may be configured to determine an operating mode for the flat panel display 12 among a plurality of operating modes including at least a first operating mode and a second operating mode. For example, in the first operating mode the controller may be configured to set the flat panel display 12 to utilize a first frame rate and a first inversion mode to save power. For example, in the second operating mode the controller 14 may be configured to set the flat panel display 12 to utilize a second frame rate, a second inversion mode, and black frame insertion to improve image quality. For example, the second frame rate may be faster than the first frame rate. For example, the second inversion mode and black frame insertion may be mutually configured to maintain a. DC balanced operation of the flat panel display 12.

For example, in some embodiments of the invention, the controller 14 may be further configured to determine the operating mode based on an amount of motion in the display image. For example, the first operating mode may correspond to a relatively low amount of motion in the display image. For example, the first frame rate may be about sixty hertz (60 Hz) and the first inversion mode may include a single frame inversion.

For example, in some embodiments of the invention the second operating mode may correspond to a relatively high amount of motion in the display image. For example, a DC balanced black frame may be inserted after each frame of image data in the second operating mode. In another example, a DC balanced black frame may be inserted after every two frames of image data in the second operating mode. For example, the second frame rate may be about one hundred twenty (120 Hz) and the second inversion mode may include a two frame inversion.

Figure 2:
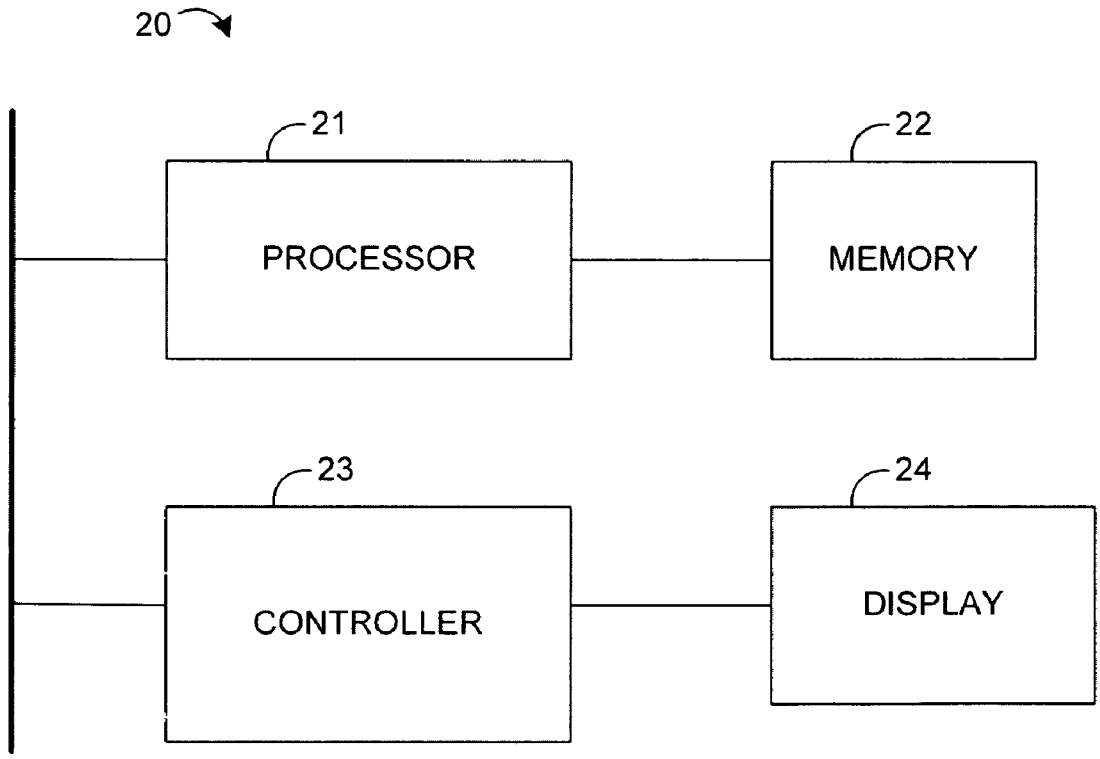
FIG. 2 is a block diagram of a processor-based system in accordance with some embodiments of the invention.

With reference to FIG. 2, in accordance with some embodiments of the invention, a processor-based electronic system 20 may include a processor 21, a memory 22 coupled to the processor 21, a controller 23 coupled to the processor 21, and a flat panel display 24 coupled to the controller 23, wherein the controller 23 is configured to control operation of the flat panel display 24. For example, the processor may be a central processing unit (CPU), a graphics processing unit (GPU), a general purpose processor or a special purpose processor. For example, the memory 22 may include code which when executed (e.g. by the processor 21 and/or controller 23) causes the processor-based system 20 to determine an operating mode for the flat panel display 24 among a plurality of operating modes including at least a first operating mode and a second operating mode, in the first operating mode set the flat panel display 24 to utilize a first frame rate and a first inversion mode to save power, and in the second operating mode set the flat panel display 24 to utilize a second frame rate, a second inversion mode, and black frame insertion to improve image quality. For example, the second frame rate may be faster than the first frame rate. For example, the second inversion mode and black frame insertion may be mutually configured to maintain a DC balanced operation of the flat panel display 24.

For example, in some embodiments of the invention the memory 22 may further include code to cause the processor-based system 20 to determine the operating mode based on an amount of motion in the display image. For example, the first operating mode may correspond to a relatively low amount of motion in the display image. For example, the first frame rate may be about sixty hertz (60 Hz) and the first inversion mode may include a single frame inversion.

For example, in some embodiments of the invention the second operating mode may correspond to a relatively high amount of motion in the display image. For example, a DC balanced black frame may be inserted after each frame of image data in the second operating mode. In another example, a DC balanced black frame may be inserted after every two frames of image data in the second operating mode. For example, the second frame rate may be about one hundred twenty hertz (120 Hz) and the second inversion mode may include a two frame inversion. For example, in some embodiments of the invention the flat panel display may include a liquid crystal display.

Figure 3:
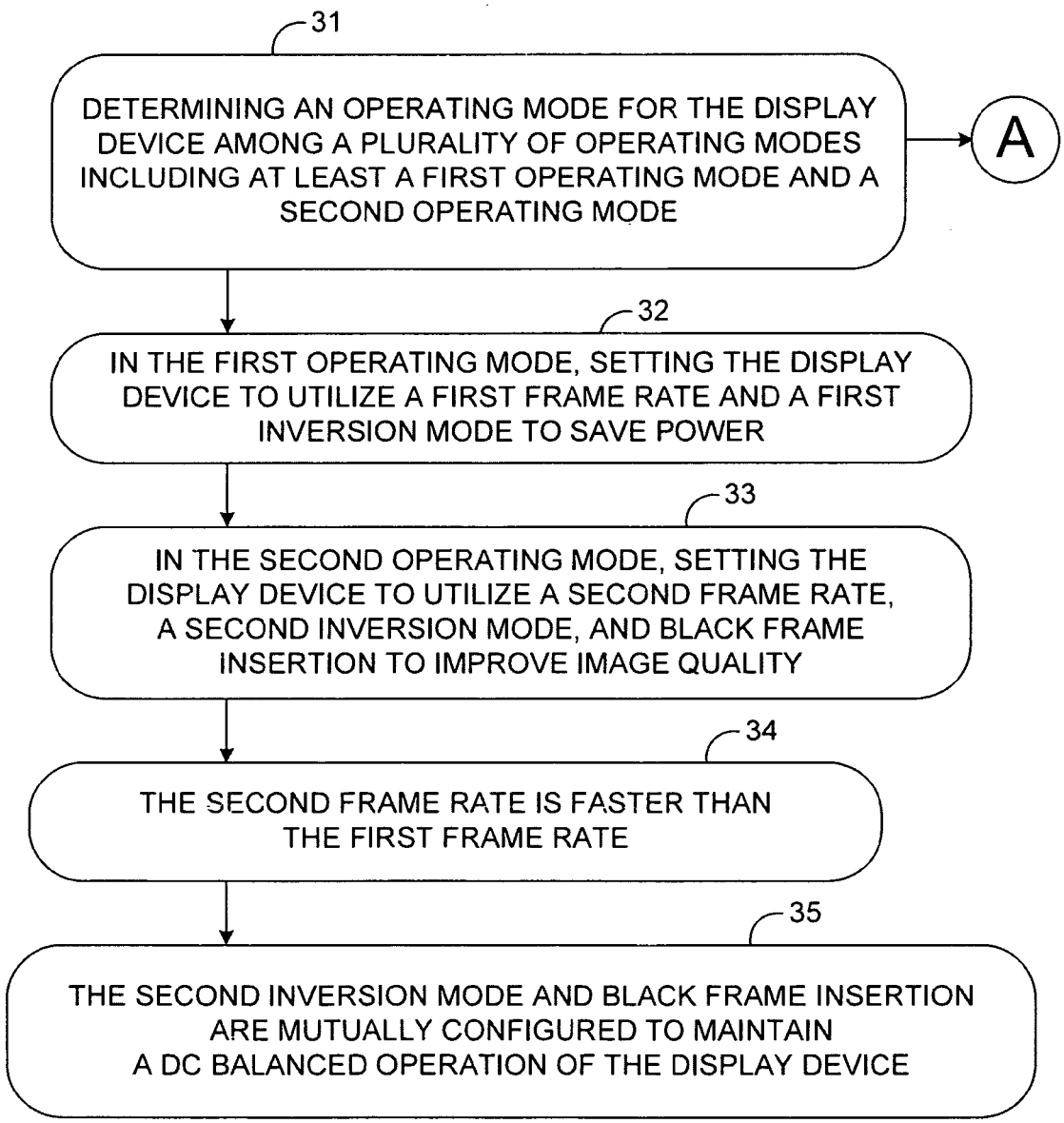
FIG. 3 is a flow diagram in accordance with some embodiments of the invention.

With reference to FIG. 3, in accordance with some embodiments of the invention a method of operating a display device may include determining an operating mode for the display device among a plurality of operating modes including at least a first operating mode and a second operating mode (e.g. at block 31), in the first operating mode, setting the display device to utilize a first frame rate and a first inversion mode to save power (e.g. at block 32), and in the second operating mode, setting the display device to utilize a second frame rate, a second inversion mode, and black frame insertion to improve image quality (e.g. at block 33). For example, the second frame rate may be faster than the first frame rate (e.g. at block 34). For example, the second inversion mode and black frame insertion may be mutually configured to maintain a DC balanced operation of the display device (e.g. at block 35).

Figure 4:
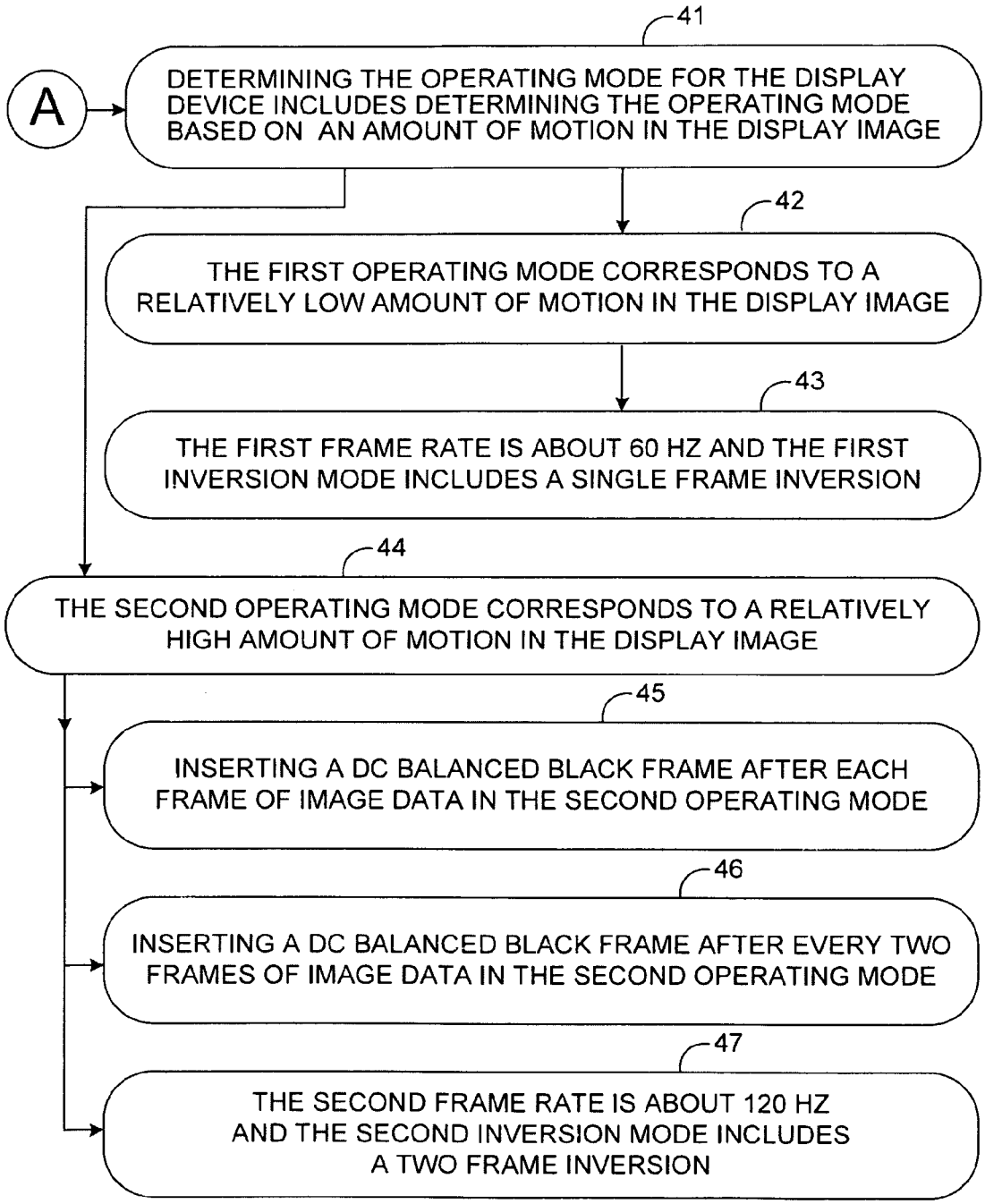
FIG. 4 is another flow diagram in accordance with some embodiments of the invention.

With reference to FIG. 4, in some embodiments of the invention, determining the operating mode for the display device may include determining the operating mode based on an amount of motion in the display image (e.g. at block 41). For example, the first operating mode may correspond to a relatively low amount of motion in the display image (e.g. at block 42). For example, the first frame rate may be about 60 Hz and the first inversion mode may include a single frame inversion (e.g. at block 43).

For example, in some embodiments of the invention the second operating mode may correspond to a relatively high amount of motion in the display image (e.g. at block 44). For example, some embodiments of the invention may further include inserting a DC balanced black frame after each frame of image data in the second operating mode (e.g. at block 45). For example, some embodiments of the invention may further include inserting a DC balanced black frame after every two frames of image data in the second operating mode (e.g. at block 46). For example, the second frame rate may be about 120 Hz and the second inversion mode may include a two frame inversion (e.g. at block 47).

Advantageously, some embodiments of the invention may provide an improved or optimized inversion control for a black frame inserted LCD. For example, the LCD may be parts of a display subsystem for mobile platforms. Advantageously, some embodiments of the invention may utilize inversion control and/or frame rate control to provide motion picture quality improvement in an LCD display.

For example, inversion may refer to a technique applied to panels where the voltage for each pixel is inverted with a regular pattern in order to keep any DC voltage at 0V. If the DC voltage is not kept at 0V, artifacts appear on the screen. In some conventional systems, BFI may interrupt the regular inversion pattern, potentially causing artifacts to appear on screen. For example, in some applications LCD panels must be operated with a DC free signal. Inversion may be used to provide the needed DC free signal, but in conventional systems introducing black frame data to improve image quality may introduce a driving signal which is not DC free (e.g. a DC level may be caused by the inserted black data). This DC level may cause serious side effects such as image sticking and permanent image burn-in for the conventional systems.

Figure 5:
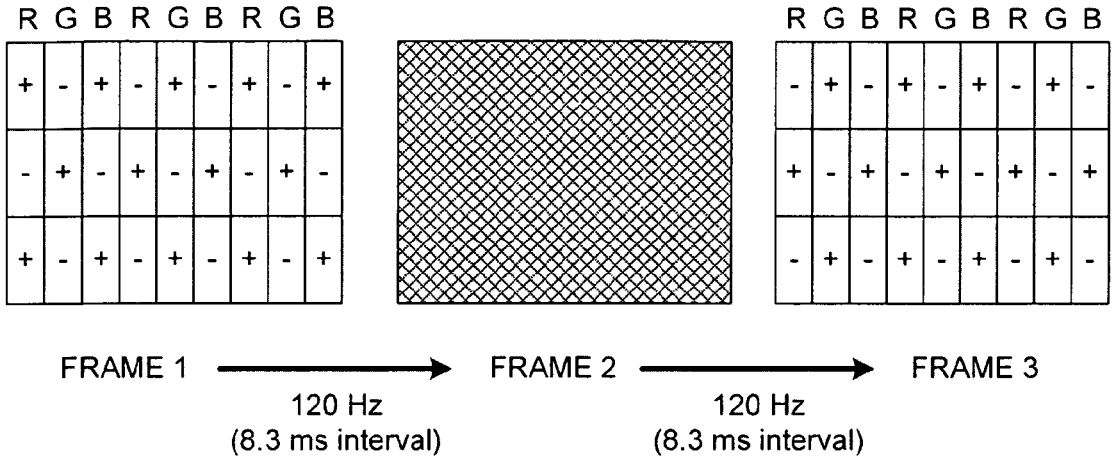
FIG. 5 is a diagram of display image frames in accordance with some embodiments of the invention.

Advantageously, some embodiments of the invention may utilize an inversion sequence and black frame insertion which are mutually configured to maintain a DC balanced operation of the display device. With reference to FIG. 5, a sequence of frames may be driven at a higher frame rate (e.g. 120 Hz vs. 60 Hz), with a two frame inversion mode, and with black frame data inserted after each image frame. For example, the inserted black frame data may be inverted every other frame corresponding to the same inversion pattern as the image data.

Figure 6:
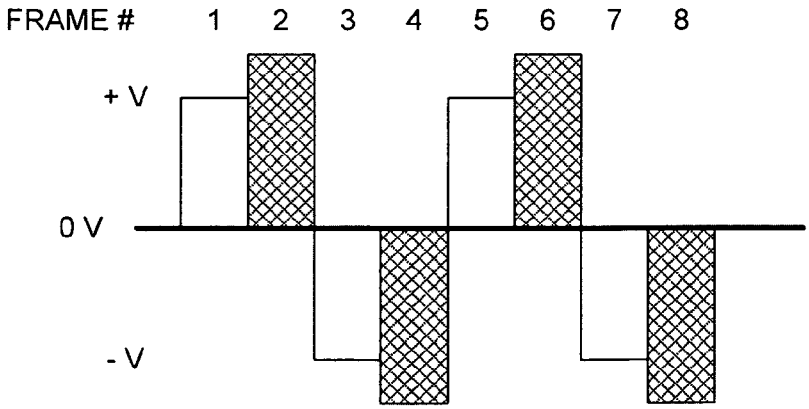
FIG. 6 is a diagram of a sequence of display frames in accordance with some embodiments of the invention.

With reference to FIG. 6, at Frame #1 image data is regularly processed (e.g. at +V). At Frame #2 black frame data is inserted and is also regularly processed (e.g. at +V). At Frame #3 a next frame of image data is inverted (e.g. at −V). At Frame #4 black frame data is inserted and is also inverted (e.g. at −V). This inversion pattern then repeats. Advantageously, the image quality may be improved by the black frame insertions and the resulting signal is DC free (e.g. =0V), thereby avoiding problems caused by DC levels in the driving signal. In this example, the two frame inversion mode and the black frame insertion are mutually configured to maintain the DC balance of the display by inserting a DC balanced black frame after each frame of image data.

In general, a relatively higher frame rate (e.g. about 120 Hz or more) may be desired when operating in a two frame inversion mode. For example, at a lower frame rate (e.g. about 60 Hz or less) the two frame inversion mode may introduce a visual artifact such as flicker. Advantageously, some embodiments of invention may be adaptive such that when the inversion mode changes the frame rate also changes (e.g. based on an amount of motion in the image and/or a desired power policy).

Figure 7:
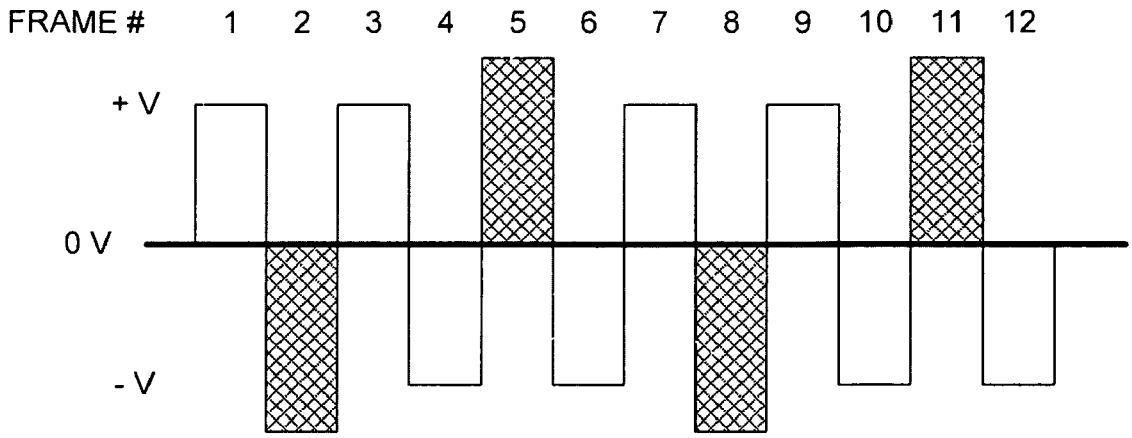
FIG. 7 is a diagram of another sequence of display frames in accordance with some embodiments of the invention.

With reference to FIG. 7, in accordance with some embodiments of the invention other inversion patterns may be utilized to insert black frame data into the frame sequence while maintaining DC balance for the display. For example, at Frame #1 image data is regularly processed (e.g. at +V). At Frame #2 black frame data is inserted and is inverted (e.g. at −V). At Frame #3 a next frame of image data is regularly processed (e.g. at +V). At Frame #4 a next frame of image data is inverted (e.g. at −V). At Frame #5 black frame data is inserted and is regularly processed (e.g. at +V). At Frame #6 a next frame of image data is inverted (e.g. at −V). This inversion pattern then repeats. Advantageously, the image quality may be improved by the black frame insertions and the resulting signal is DC free (e.g. =0V), thereby avoiding problems caused by DC levels in the driving signal. In this example, the two frame inversion mode and the black frame insertion are mutually configured to maintain the DC balance of the display by inserting a DC balanced black frame after the first frame of image data and every two frames of image data thereafter.

Figure 8:
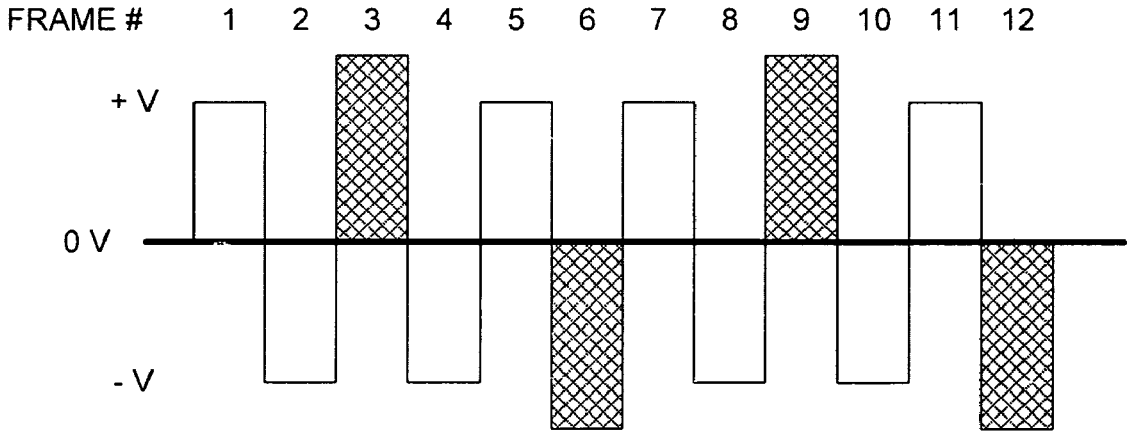
FIG. 8 is a diagram of another sequence of display frames in accordance with some embodiments of the invention.

With reference to FIG. 8, in another example at Frame #1 image data is regularly processed (e.g. at +V). At Frame #2 a next frame of image data is inverted (e.g. at −V). At Frame #3 black frame data is inserted and is regularly processed (e.g. at +V). At Frame #4 a next frame of image data is inverted (e.g. at −V). At Frame #5 image data is regularly processed (e.g. at +V). At Frame #6 black frame data is inserted and is inverted (e.g. at −V). This inversion pattern then repeats. Advantageously, the image quality may be improved by the black frame insertions and the resulting signal is DC free (e.g. =0V), thereby avoiding problems caused by DC levels in the driving signal. In this example, the two frame inversion mode and the black frame insertion are mutually configured to maintain the DC balance of the display by inserting a DC balanced black frame after every two frames of image data.

Figure 9:
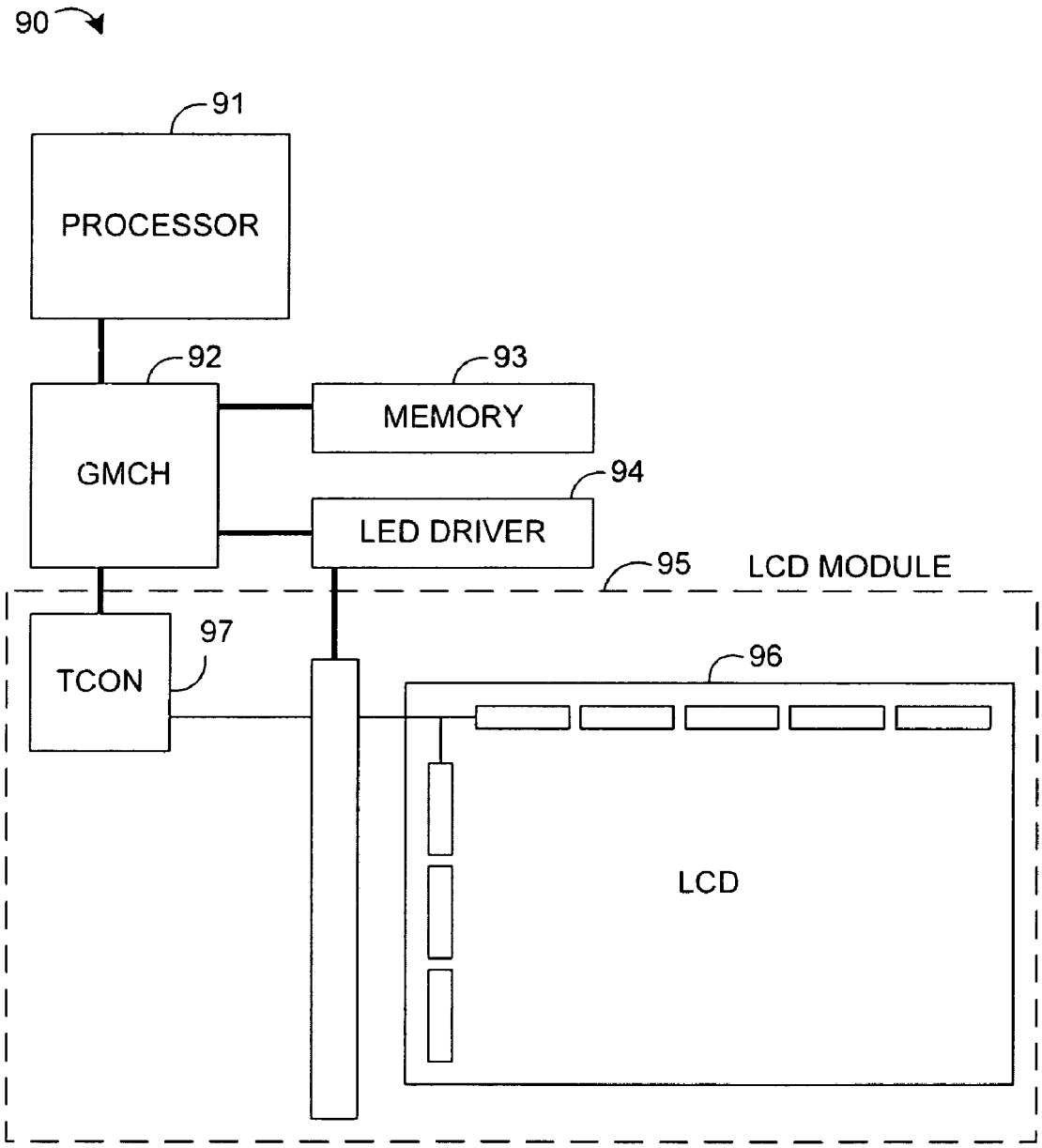
FIG. 9 is a block diagram of another processor-based system in accordance with some embodiments of the invention.

With reference to FIG. 9, a processor-based system 90 may include a processor 91 and a graphics and memory controller hub (GMCH) 92 coupled to the processor 91. The GMCH 92 may be further coupled to a memory 93 and an LED driver 94. The LED driver may drive an LED backlight for an LCD module 95. The LCD module 95 may include an LCD display panel 96 coupled to a timing controller (TCON) 97. The GMCH 92 may be coupled to the TCON 97. For example, the memory 93 may store an image to be displayed on the LCD display panel 96.

For example, the system 90 may be a mobile platform such as a notebook computer, a netbook, a handheld gaming device, a mobile internet device (MID), a personal digital assistant (PDA), a cell phone, or other mobile processor-based device. Depending on the circumstances, a mobile platform may benefit from a longer battery life and/or excellent picture quality experiences. Advantageously, some embodiments of the invention may provide a balance between a power saving mode utilizing a lower frame rate and better picture quality for high motion contents at a higher frame rate (e.g. about 120 Hz) and black frame insertion (BFI).

For example, switching between the two operating modes may be determined based on a power policy. For example, the higher frame rate and BFI may be selected whenever the mobile device is connected to an external power source (e.g. an AC charger). For example, the user may utilize an operating system on the mobile device to select a display setting based on a desired outcome (e.g. longer battery life or better picture quality). For example, the operating mode may be selected dynamically based on usage and display activity (e.g. switching to lower frame rate, single frame inversion, and no BFI when the display image is static, switching to higher frame rate, two frame inversion and BFI when a video is playing).

Numerous other policy based, user input based, or dynamic software based determinations may be utilized to make the final determination of the operating mode for the display. For example, if the image contents correspond to a low motion picture, the system may set to frame rate=60 Hz (or lower) and single frame inversion to achieve low power. If the image contents correspond to a high motion picture, the system may be set to frame rate=120 Hz with BFI and two frame inversion to achieve better picture quality for high motion picture contents. Advantageously, this achieves a DC free signal and avoids artifacts.

In some embodiments of the invention, the LCD panel may be configured to adapt to the expected inversion mode by frame rate and/or V-sync signal polarity encoding. In some embodiments of the invention, the inversion mode may be set by a command (e.g. in the case of a Mobile Industry Processor Interface for Display Serial Interface (MIPI DSI) system or similar system which has communication method by command). In some embodiments of the invention, the inversion mode may be set over a sideband signal such as the AUX CH interface in DisplayPort. Advantageously, some embodiments of the invention may dynamically adjust the frame rate without visual degradation (e.g. in response to power policy, display activity, and/or user input).

Those skilled in the art will appreciate that the diagrams of FIGS. 1-9 may be implemented in any of a number of arrangements of hardware, software, and/or firmware. For example, the diagrams may be completely implemented by special purpose hardware circuits. Alternatively, the diagrams may be completely implemented by software running on a general purpose processor. Alternatively, the diagrams may be selectively partitioned between special purpose hardware and software running on a general purpose processor.

The foregoing and other aspects of the invention are achieved individually and in combination. The invention should not be construed as requiring two or more of such aspects unless expressly required by a particular claim. Moreover, while the invention has been described in connection with what is presently considered to be the preferred examples, it is to be understood that the invention is not limited to the disclosed examples, but on the contrary, is intended to cover various modifications and equivalent arrangements included within the spirit and the scope of the invention.

What is claimed is:

1. A method of operating a display device, comprising:

determining an operating mode for the display device among a plurality of operating modes including at least a first operating mode and a second operating mode;

in the first operating mode, setting the display device to utilize a first frame rate and a first inversion mode to save power; and in the second operating mode, setting the display device to utilize a second frame rate, a second inversion mode, and black frame insertion to improve image quality, wherein the second frame rate is faster than the first frame rate, and wherein the second inversion mode includes inverting one or more frames of image data after a first number of frames of image data, and the black frame insertion includes inserting a DC balanced black frame after a second number of frames of image data, and wherein the second inversion mode and the black frame insertion are mutually configured to maintain a DC balanced operation of the display device.

2. The method of claim 1, wherein determining the operating mode for the display device comprises:

determining the operating mode based on an amount of motion in the display image.

3. The method of claim 2, wherein the first operating mode corresponds to a relatively low amount of motion in the display image.

4. The method of claim 3, wherein the first frame rate is about sixty hertz and the first inversion mode comprises a single frame inversion.

5. The method of claim 2, wherein the second operating mode corresponds to a relatively high amount of motion in the display image.

6. The method of claim 5, further comprising:

inserting the DC balanced black frame after each frame of image data in the second operating mode.

7. The method of claim 5, further comprising:

inserting the DC balanced black frame after every two frames of image data in the second operating mode.

8. The method of claim 5, wherein the second frame rate is about one hundred twenty hertz and the second inversion mode comprises a two frame inversion.

9. The method of claim 1, wherein the first number of frames of image data and the second number of frames of frames of image data are the same.

10. A display apparatus, comprising:

a flat panel display; and a controller coupled to the flat panel display, wherein the controller is configured to:

determine an operating mode for the flat panel display among a plurality of operating modes including at least a first operating mode and a second operating mode;

in the first operating mode, set the flat panel display to utilize a first frame rate and a first inversion mode to save power; and in the second operating mode, set the flat panel display to utilize a second frame rate, a second inversion mode, and black frame insertion to improve image quality, wherein the second frame rate is faster than the first frame rate, and wherein the second inversion mode is to include inverting one or more frames of image data after a first number of frames of image data, and the black frame insertion is to include inserting a DC balanced black frame after a second number of frames of image data, and wherein the second inversion mode and the black frame insertion are mutually configured to maintain a DC balanced operation of the flat panel display.

11. The display apparatus of claim 10, wherein the controller is further configured to:

determine the operating mode based on an amount of motion in the display image.

12. The display apparatus of claim 11, wherein the first operating mode corresponds to a relatively low amount of motion in the display image.

13. The display apparatus of claim 12, wherein the first frame rate is about sixty hertz and the first inversion mode comprises a single frame inversion.

14. The display apparatus of claim 11, wherein the second operating mode corresponds to a relatively high amount of motion in the display image.

15. The display apparatus of claim 14, wherein the DC balanced black frame is inserted after each frame of image data in the second operating mode.

16. The display apparatus of claim 14, wherein the DC balanced black frame is inserted after every two frames of image data in the second operating mode.

17. The display apparatus of claim 14, wherein the second frame rate is about one hundred twenty hertz and the second inversion mode comprises a two frame inversion.

18. The display apparatus of claim 10, wherein the first number of frames of image data and the second number of frames of frames of image data are the same.

19. A processor-based electronic system, comprising:

a processor;

a memory coupled to the processor;

a controller coupled to the processor; and a flat panel display coupled to the controller, wherein the controller is configured to control operation of the flat panel display, and wherein the memory includes code which when executed causes the processor-based system to:

determine an operating mode for the flat panel display among a plurality of operating modes including at least a first operating mode and a second operating mode;

in the first operating mode, set the flat panel display to utilize a first frame rate and a first inversion mode to save power; and in the second operating mode, set the flat panel display to utilize a second frame rate, a second inversion mode, and black frame insertion to improve image quality, wherein the second frame rate is faster than the first frame rate, and wherein the second inversion mode is to include inverting one or more frames of image data after a first number of frames of image data, and the black frame insertion is to include inserting a DC balanced black frame after a second number of frames of image data, and wherein the second inversion mode and the black frame insertion are mutually configured to maintain a DC balanced operation of the flat panel display.

20. The processor-based electronic system of claim 19, wherein the memory further includes code to cause the processor-based system to:

determine the operating mode based on an amount of motion in the display image.

21. The processor-based electronic system of claim 20, wherein the first operating mode corresponds to a relatively low amount of motion in the display image.

22. The processor-based electronic system of claim 21, wherein the first frame rate is about sixty hertz and the first inversion mode comprises a single frame inversion.

23. The processor-based electronic system of claim 20, wherein the second operating mode corresponds to a relatively high amount of motion in the display image.

24. The processor-based electronic system of claim 23, wherein the DC balanced black frame is inserted after each frame of image data in the second operating mode.

25. The processor-based electronic system of claim 23, wherein the DC balanced black frame is inserted after every two frames of image data in the second operating mode.

26. The processor-based electronic system of claim 23, wherein the second frame rate is about one hundred twenty hertz and the second inversion mode comprises a two frame inversion.

27. The processor-based electronic system of claim 19, wherein the flat panel display comprises a liquid crystal display.

28. The processor-based electronic system of claim 19, wherein the first number of frames of image data and the second number of frames of frames of image data are the same.

* * * * *